US009303878B2

(12) United States Patent
Burt et al.

(10) Patent No.: US 9,303,878 B2
(45) Date of Patent: Apr. 5, 2016

(54) HYBRID RANGE AND METHOD OF USE THEREOF

(75) Inventors: Ashley Wayne Burt, Louisville, KY (US); John Mark Smith, Louisville, KY (US)

(73) Assignee: General Electric Company, Schenectady, NY (US)

( * ) Notice: Subject to any disclaimer, the term of this patent is extended or adjusted under 35 U.S.C. 154(b) by 820 days.

(21) Appl. No.: 13/205,994

(22) Filed: Aug. 9, 2011

(65) Prior Publication Data

US 2011/0290781 A1 Dec. 1, 2011

Related U.S. Application Data

(63) Continuation-in-part of application No. 12/948,135, filed on Nov. 17, 2010, which is a continuation-in-part of application No. 12/559,597, filed on Sep. 15, 2009, now abandoned.

(60) Provisional application No. 61/097,082, filed on Sep. 15, 2008.

(51) Int. Cl.

| | |
|---|---|
| ***F24C 3/12*** | (2006.01) |
| ***H02J 3/14*** | (2006.01) |
| ***G06Q 50/06*** | (2012.01) |
| ***H02J 3/00*** | (2006.01) |

(52) U.S. Cl.

CPC ..... *F24C 3/128* (2013.01)

(58) Field of Classification Search

CPC ..... H02J 3/14; H02J 3/382; H02J 3/06; H02J 3/00; H02J 13/0086; Y04S 20/222; Y02B 70/3225; G06Q 50/06; G06G 7/635; H05B 6/6473; F24C 3/128

USPC ..... 700/295, 291, 299, 297, 286; 307/38, 307/39

See application file for complete search history.

(56) References Cited

U.S. PATENT DOCUMENTS

| | | | |
|---|---|---|---|
| 2,545,054 | A | 3/1951 | Stitz |
| 3,683,343 | A | 8/1972 | Feldman et al. |
| 3,720,073 | A | 3/1973 | McCarty |
| 4,048,812 | A | 9/1977 | Thomason |

(Continued)

FOREIGN PATENT DOCUMENTS

| | | | |
|---|---|---|---|
| CN | 1692317 | A | 11/2005 |
| CN | 101013979 | A | 8/2007 |

(Continued)

OTHER PUBLICATIONS

Search Report from CN Application No. 201010135268.8 dated Oct. 24, 2012.

(Continued)

*Primary Examiner* — Carlos Ortiz Rodriguez
*Assistant Examiner* — Jason Lin
(74) *Attorney, Agent, or Firm* — Dority & Manning, P.A.

(57) ABSTRACT

An appliance includes an oven cavity; a gas burner disposed within the oven cavity; an electrical heating element disposed within the oven cavity; and a controller in operative communication with the gas burner and the electrical heating element, the controller being configured to receive a signal indicative of a current state of an associated utility, and to selectively activate at least one of the gas burner and the electrical heating element based upon the signal.

17 Claims, 4 Drawing Sheets

(56) References Cited

U.S. PATENT DOCUMENTS 4,167,786 A 9/1979 Miller et al.
4,190,756 A 2/1980 Foerstner
4,216,658 A 8/1980 Baker et al.
4,247,786 A 1/1981 Hedges
4,362,970 A 12/1982 Grady
4,454,509 A 6/1984 Buennagel et al.
4,637,219 A 1/1987 Grose
4,659,943 A 4/1987 Virant
4,718,403 A 1/1988 McCall
4,731,547 A 3/1988 Alenduff et al.
4,841,281 A * 6/1989 Melvin, Jr. ..... 375/297
4,903,502 A 2/1990 Hanson et al.
4,926,837 A * 5/1990 Parker et al. ..... 126/21 A
4,998,024 A 3/1991 Kirk et al.
5,040,724 A 8/1991 Brinkruff et al.
5,137,041 A 8/1992 Hall et al.
5,183,998 A 2/1993 Hoffman et al.
5,220,807 A 6/1993 Bourne et al.
5,224,355 A 7/1993 So et al.
5,230,467 A 7/1993 Kubsch et al.
5,289,362 A 2/1994 Liebl et al.
5,408,578 A 4/1995 Bolivar
5,430,430 A 7/1995 Gilbert
5,451,843 A 9/1995 Kahn et al.
5,462,225 A 10/1995 Massara et al.
5,479,157 A 12/1995 Suman et al.
5,479,558 A 12/1995 White et al.
5,481,140 A 1/1996 Maruyama et al.
5,488,565 A * 1/1996 Kennon et al. ..... 700/306
5,495,551 A 2/1996 Robinson et al.
5,504,306 A 4/1996 Russell et al.
5,505,377 A 4/1996 Weiss
5,515,692 A 5/1996 Sterber et al.
5,574,979 A 11/1996 West
5,581,132 A 12/1996 Chadwick
5,635,895 A 6/1997 Murr
5,706,191 A 1/1998 Bassett et al.
5,761,083 A 6/1998 Brown et al.
5,805,856 A * 9/1998 Hanson ..... 392/465
5,816,491 A 10/1998 Berkeley et al.
5,866,880 A 2/1999 Seitz et al.
5,874,902 A 2/1999 Heinrich et al.
5,880,536 A 3/1999 Mardirossian
5,883,802 A 3/1999 Harris
5,886,647 A 3/1999 Badger et al.
5,926,776 A 7/1999 Glorioso et al.
5,937,942 A 8/1999 Bias et al.
5,956,462 A 9/1999 Langford
6,018,150 A 1/2000 Maher
6,026,651 A 2/2000 Sandelman
6,080,971 A 6/2000 Seitz
6,118,099 A 9/2000 Lake
6,144,161 A 11/2000 Kimmich et al.
6,179,213 B1 1/2001 Gibino et al.
6,181,985 B1 * 1/2001 O'Donnell et al. ..... 700/295
6,185,483 B1 2/2001 Drees
6,229,433 B1 5/2001 Rye et al.
6,246,831 B1 6/2001 Seitz et al.
6,380,866 B1 4/2002 Sizer et al.
6,400,103 B1 6/2002 Adamson
6,480,753 B1 11/2002 Calder et al.
6,489,597 B1 12/2002 Hornung
6,553,595 B1 4/2003 Bruntz et al.
6,631,622 B1 10/2003 Ghent et al.
6,694,753 B1 2/2004 Lanz et al.
6,694,927 B1 2/2004 Pouchak et al.
6,704,401 B2 3/2004 Piepho et al.
6,778,868 B2 8/2004 Imamura et al.
6,784,872 B1 8/2004 Matsui et al.
6,806,446 B1 10/2004 Neale
6,817,195 B2 11/2004 Rafalovich et al.
6,828,695 B1 12/2004 Hansen
6,860,431 B2 3/2005 Jayadev
6,872,919 B2 * 3/2005 Wakefield et al. ..... 219/400
6,873,876 B1 3/2005 Aisa
6,879,059 B2 4/2005 Sleva
6,904,385 B1 6/2005 Budike
6,922,598 B2 7/2005 Lim et al.
6,943,321 B2 9/2005 Carbone et al.
6,943,324 B2 * 9/2005 Ahuja ..... 219/446.1
6,961,642 B2 11/2005 Horst
6,983,210 B2 1/2006 Matsubayashi et al.
7,010,363 B2 3/2006 Donnelly et al.
7,039,575 B2 5/2006 Juneau
7,043,380 B2 5/2006 Rodenberg et al.
7,053,790 B2 5/2006 Jang et al.
7,057,140 B2 6/2006 Pittman
7,069,090 B2 * 6/2006 Huffington et al. ..... 700/45
7,082,380 B2 7/2006 Wiebe et al.
7,110,832 B2 * 9/2006 Ghent ..... 700/16
7,155,305 B2 12/2006 Hayes et al.
7,164,851 B2 1/2007 Sturm et al.
7,206,670 B2 4/2007 Pimputkar et al.
7,266,962 B2 9/2007 Montuoro et al.
7,274,973 B2 9/2007 Nichols et al.
7,274,975 B2 9/2007 Miller et al.
7,368,686 B2 5/2008 Etheredge et al.
7,372,002 B2 5/2008 Nakamura et al.
7,420,140 B2 9/2008 Lenhart et al.
7,420,293 B2 9/2008 Donnelly et al.
7,446,646 B2 11/2008 Huomo
7,478,070 B2 1/2009 Fukui et al.
7,541,941 B2 6/2009 Bogolea et al.
7,561,977 B2 7/2009 Horst et al.
7,565,813 B2 7/2009 Pouchak
7,685,849 B2 3/2010 Worthington
7,720,035 B2 5/2010 Oh et al.
7,751,339 B2 7/2010 Melton et al.
7,783,390 B2 8/2010 Miller
7,919,729 B2 4/2011 Hsu
7,925,388 B2 4/2011 Ying
7,962,248 B2 6/2011 Flohr
7,991,513 B2 8/2011 Pitt
8,024,073 B2 9/2011 Imes et al.
8,027,752 B2 9/2011 Castaldo et al.
8,033,686 B2 10/2011 Recker et al.
8,094,037 B2 1/2012 Unger
8,185,252 B2 5/2012 Besore
8,190,302 B2 5/2012 Burt et al.
8,355,748 B2 1/2013 Abe et al.
8,367,984 B2 2/2013 Besore et al.
2001/0025349 A1 9/2001 Sharood et al.
2001/0048361 A1 12/2001 Mays et al.
2002/0024332 A1 2/2002 Gardner
2002/0071689 A1 6/2002 Miyamoto
2002/0125246 A1 9/2002 Cho et al.
2002/0175806 A1 11/2002 Marneweck et al.
2002/0196124 A1 12/2002 Howard et al.
2002/0198629 A1 12/2002 Ellis
2003/0036820 A1 2/2003 Yellepeddy et al.
2003/0043845 A1 3/2003 Lim et al.
2003/0178894 A1 9/2003 Ghent
2003/0193405 A1 10/2003 Hunt et al.
2003/0194979 A1 10/2003 Richards et al.
2003/0233201 A1 * 12/2003 Horst et al. ..... 702/62
2004/0024483 A1 2/2004 Holcombe
2004/0034484 A1 2/2004 Solomita et al.
2004/0098171 A1 * 5/2004 Horst ..... 700/295
2004/0100199 A1 5/2004 Yang
2004/0107510 A1 6/2004 Buckroyd et al.
2004/0112070 A1 6/2004 Schanin
2004/0117330 A1 * 6/2004 Ehlers et al. ..... 705/412
2004/0118008 A1 6/2004 Jeong et al.
2004/0128266 A1 7/2004 Yellepeddy et al.
2004/0133314 A1 7/2004 Ehlers et al.
2004/0139038 A1 7/2004 Ehlers et al.
2004/0254654 A1 12/2004 Donnelly et al.
2005/0011205 A1 1/2005 Holmes et al.
2005/0134469 A1 6/2005 Odorcic et al.
2005/0138929 A1 6/2005 Enis et al.
2005/0173401 A1 8/2005 Bakanowski et al.
2005/0184046 A1 8/2005 Sterling
2005/0190074 A1 9/2005 Cumeralto et al.
2006/0031180 A1 2/2006 Tamarkin et al.

(56) References Cited

U.S. PATENT DOCUMENTS

| | | | | |
|---|---|---|---|---|
| 2006/0036338 | A1* | 2/2006 | Harkcom et al. | 700/83 |
| 2006/0068728 | A1 | 3/2006 | Ishidoshiro et al. | |
| 2006/0095164 | A1 | 5/2006 | Donnelly et al. | |
| 2006/0123807 | A1 | 6/2006 | Sullivan et al. | |
| 2006/0159043 | A1 | 7/2006 | Delp et al. | |
| 2006/0162973 | A1* | 7/2006 | Harris et al. | 180/65.3 |
| 2006/0190139 | A1 | 8/2006 | Reaume et al. | |
| 2006/0208570 | A1 | 9/2006 | Christian et al. | |
| 2006/0259547 | A1* | 11/2006 | Bogatin et al. | 709/203 |
| 2006/0272830 | A1 | 12/2006 | Fima et al. | |
| 2006/0276938 | A1 | 12/2006 | Miller | |
| 2006/0289436 | A1 | 12/2006 | Carbone et al. | |
| 2007/0005195 | A1 | 1/2007 | Pasquale et al. | |
| 2007/0008076 | A1 | 1/2007 | Rodgers et al. | |
| 2007/0030116 | A1 | 2/2007 | Feher | |
| 2007/0043478 | A1* | 2/2007 | Ehlers et al. | 700/276 |
| 2007/0136217 | A1 | 6/2007 | Johnson et al. | |
| 2007/0151311 | A1 | 7/2007 | McAllister et al. | |
| 2007/0185675 | A1 | 8/2007 | Papamichael et al. | |
| 2007/0203860 | A1 | 8/2007 | Golden et al. | |
| 2007/0213880 | A1 | 9/2007 | Ehlers | |
| 2007/0220907 | A1 | 9/2007 | Ehlers | |
| 2007/0229236 | A1 | 10/2007 | Mercer et al. | |
| 2007/0245161 | A1* | 10/2007 | Shaw et al. | 713/300 |
| 2007/0271006 | A1 | 11/2007 | Golden et al. | |
| 2007/0276547 | A1 | 11/2007 | Miller | |
| 2008/0029081 | A1 | 2/2008 | Gagas et al. | |
| 2008/0034768 | A1 | 2/2008 | Pimentel et al. | |
| 2008/0083729 | A1 | 4/2008 | Etheredge et al. | |
| 2008/0106147 | A1 | 5/2008 | Caggiano et al. | |
| 2008/0120790 | A1 | 5/2008 | Ashrafzadeh et al. | |
| 2008/0122585 | A1 | 5/2008 | Castaldo et al. | |
| 2008/0136581 | A1 | 6/2008 | Heilman et al. | |
| 2008/0144550 | A1 | 6/2008 | Makhlouf et al. | |
| 2008/0167756 | A1 | 7/2008 | Golden et al. | |
| 2008/0167931 | A1 | 7/2008 | Gerstemeier et al. | |
| 2008/0172312 | A1 | 7/2008 | Synesiou et al. | |
| 2008/0177678 | A1 | 7/2008 | Di Martini et al. | |
| 2008/0179052 | A1 | 7/2008 | Kates | |
| 2008/0204240 | A1 | 8/2008 | Hilgers et al. | |
| 2008/0215263 | A1* | 9/2008 | Flohr | 702/62 |
| 2008/0258633 | A1 | 10/2008 | Voysey | |
| 2008/0272934 | A1* | 11/2008 | Wang et al. | 340/870.11 |
| 2008/0277487 | A1* | 11/2008 | Mueller et al. | 236/46 A |
| 2009/0006878 | A1 | 1/2009 | Borghetti et al. | |
| 2009/0038369 | A1* | 2/2009 | Vondras | 73/1.02 |
| 2009/0063257 | A1 | 3/2009 | Zak et al. | |
| 2009/0105888 | A1 | 4/2009 | Flohr et al. | |
| 2009/0146838 | A1 | 6/2009 | Katz | |
| 2009/0171862 | A1 | 7/2009 | Harrod et al. | |
| 2009/0235675 | A1 | 9/2009 | Chang et al. | |
| 2009/0240381 | A1 | 9/2009 | Lane | |
| 2009/0254396 | A1* | 10/2009 | Metcalfe | 705/8 |
| 2009/0326728 | A1* | 12/2009 | Chrisop et al. | 700/295 |
| 2010/0017242 | A1 | 1/2010 | Hamilton et al. | |
| 2010/0070091 | A1 | 3/2010 | Watson et al. | |
| 2010/0092625 | A1 | 4/2010 | Finch et al. | |
| 2010/0131117 | A1 | 5/2010 | Mattiocco et al. | |
| 2010/0175719 | A1 | 7/2010 | Finch et al. | |
| 2010/0179708 | A1 | 7/2010 | Watson et al. | |
| 2010/0262963 | A1 | 10/2010 | Wassermann et al. | |
| 2010/0301774 | A1 | 12/2010 | Chemel et al. | |
| 2011/0001438 | A1 | 1/2011 | Chemel et al. | |
| 2011/0062142 | A1 | 3/2011 | Steurer | |
| 2011/0085287 | A1 | 4/2011 | Ebrom et al. | |
| 2011/0087382 | A1 | 4/2011 | Santacatterina et al. | |
| 2011/0095017 | A1 | 4/2011 | Steurer | |
| 2011/0106328 | A1 | 5/2011 | Zhou et al. | |
| 2011/0114627 | A1 | 5/2011 | Burt et al. | |
| 2011/0123179 | A1 | 5/2011 | Roetker et al. | |
| 2011/0148390 | A1 | 6/2011 | Burt et al. | |
| 2011/0153106 | A1 | 6/2011 | Drake et al. | |
| 2011/0181114 | A1 | 7/2011 | Hodges et al. | |
| 2011/0290781 | A1 | 12/2011 | Burt et al. | |
| 2012/0054123 | A1 | 3/2012 | Broniak et al. | |

FOREIGN PATENT DOCUMENTS

| | | | |
|---|---|---|---|
| EP | 1496324 | A1 | 1/2005 |
| GB | 2105127 | A | 3/1983 |
| JP | 11313441 | A2 | 11/1999 |
| KR | 20060085711 | A | 7/2006 |
| WO | 86/00976 | A1 | 2/1986 |
| WO | 90/12261 | A1 | 10/1990 |
| WO | 98/48335 | A1 | 10/1998 |
| WO | 2007/060059 | A1 | 5/2007 |
| WO | 2007136456 | A2 | 11/2007 |

OTHER PUBLICATIONS

Weisstein, Eric W. "At Least One.", From MathWorld—A Wolfram Web Resource. http://mathworld.wolfram.com/AtLeastOne.html, p. 1, 2013.

International Search Report from PCT Application No. PCT/US2009/056878, Nov. 17, 2009.

International Search Report from PCT Application No. PCT/US2009/056882, Nov. 4, 2009.

International Search Report from PCT Application No. PCT/US2009/056883, Oct. 26, 2009.

International Search Report from PCT Application No. PCT/US2009/056886, Nov. 5, 2009.

International Search Report from PCT Application No. PCT/US2009/056889, Nov. 10, 2009.

International Search Report from PCT Application No. PCT/US2009/056894, Nov. 13, 2009.

International Search Report from PCT Application No. PCT/US2009/056895, Nov. 9, 2009.

International Search Report from PCT Application No. PCT/US2009/056901, Nov. 10, 2009.

International Search Report from PCT Application No. PCT/US2009/056906, Nov. 10, 2009.

International Search Report from PCT Application No. PCT/US2009/056913, Nov. 10, 2009.

International Search Report from PCT Application No. PCT/US2009/056914, Nov. 2, 2009.

International Search Report from PCT Application No. PCT/US2009/056919, Nov. 2, 2009.

Search Report from EP Application No. 10153695.1, May 24, 2012.

Real-Time Feedback, Natural Resources Canada via website www.nrcan.gc.ca , 2008, http://oee.nrcan.gc.ca/publications/equipment/10918.

International Search Report from PCT Application No. PCT/US2009/056911, Mar. 10, 2010.

Lemay et al., An Integrated Architecture for Demand Response Communications and Control, University of Illinois Urbana-Champaign, Oct. 28, 2008.

* cited by examiner

HYBRID RANGE AND METHOD OF USE THEREOF

CROSS REFERENCE TO RELATED APPLICATIONS

The present application is a Continuation-in-Part of U.S. patent application Ser. No. 12/948,135, filed Nov. 17, 2010, which is incorporated herein by reference and is in turn a Continuation-in-Part of U.S. patent application Ser. No. 12/559,597, filed Sep. 15, 2009, now abandoned, which is incorporated herein by reference and claims priority from U.S. Provisional Patent Application Ser. No. 61/097,082, filed Sep. 15, 2008, which is incorporated herein by reference.

BACKGROUND

The present disclosure generally relates to energy management of household consumer appliances, and more particularly to energy management in hybrid cooking appliances.

Utilities typically charge a flat rate for energy consumption, but with the increasing cost of fuel prices and high energy usage at certain parts of the day, generally referred to herein as "peak demand" or "peak demand periods", utilities have to buy more energy to supply customers during these peak demand periods. Consequently, utilities tend to charge higher rates during peak demand periods. If demand during peak periods can be lowered, then a potential cost savings can be achieved and the load that the utility has to accommodate during peak demand periods is lessened.

One proposed solution is to provide a system where a controller "switches" the actual energy supply to the appliance or control unit on and off. However, there is no active control beyond the mere on/off switching. Another method involves demand side management (DSM), where a control device in an electromechanical appliance can delay, adjust or disable power consuming features to reduce power consumption. However, such DSM devices simply switch off or reduce loads without any feedback regarding the loads in use.

Electrical utilities moving to an Advanced Metering Infrastructure (AMI) system will need to communicate to appliances, HVAC, water heaters, ranges, etc. in a home or office building. In these types of advanced systems, the utility can transmit a signal to appliances employing "smart" metering devices or systems to indicate periods of peak demand. These "smart" devices can then employ various load shedding processes to reduce the demand on the utility or grid.

As described above, various factors can influence the relative costs associated with use of different types of heating elements, such as electric or gas. It would be advantageous to be able to switch between different energy sources during peak demand periods or when one energy source is less costly than another. Accordingly, it would be desirable to provide a cooking appliance that overcomes at least some of the problems identified above.

BRIEF DESCRIPTION OF THE DISCLOSED EMBODIMENTS

As described herein, the exemplary embodiments overcome one or more of the above or other disadvantages known in the art.

One aspect of the disclosed embodiments relates to an appliance. The appliance includes a controller and an oven cavity with a gas burner and an electrical heating element mounted therein. The controller is in operative communication with the gas burner and the electrical heating element. The controller is configured to receive a signal indicative of a current state of an associated utility, and to selectively activate at least one of the gas burner and the electrical heating element based upon the signal.

Another aspect of the disclosed embodiments relates to an oven. The oven includes a controller and an oven cavity with a gas burner and an electrical heating element disposed therein. The controller is in operative communication with the gas burner and the electrical heating element. The controller is configured to calculate an energy supply factor, and to selectively activate at least one of the gas burner and the electrical heating element based upon the energy supply factor.

Another aspect of the disclosed embodiments relates to a method of operating an oven having a controller and an oven cavity with a gas burner and an electrical heating element mounted therein and in operative communication with the controller. The method includes calculating an energy supply factor at the controller, and in response to the calculated energy supply factor, selectively activating at least one of the gas burner and the electrical heating element.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE DISCLOSURE

Figure 1:
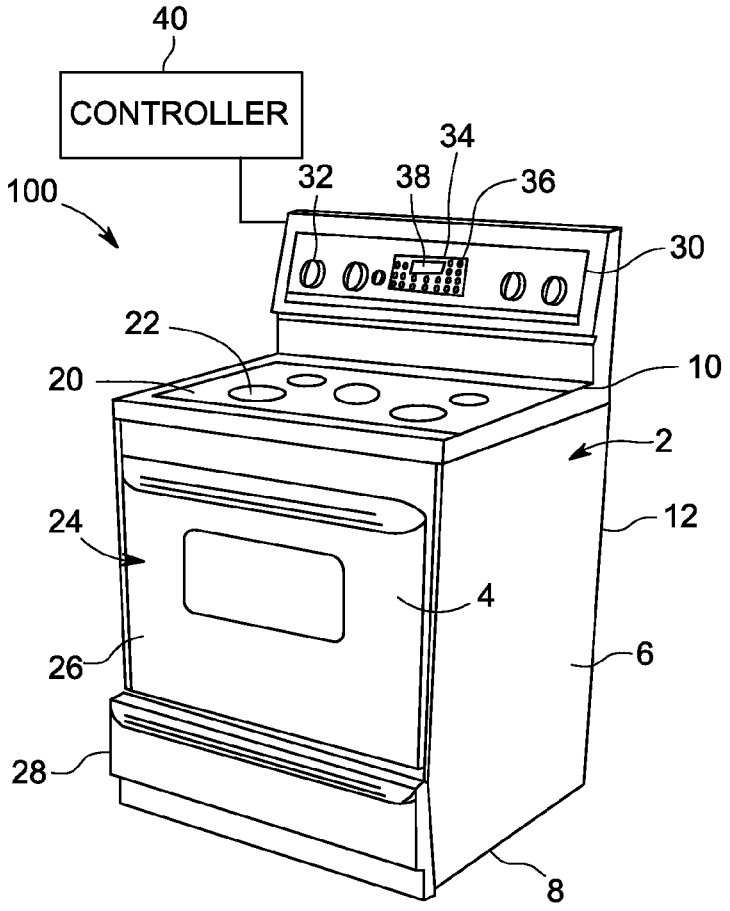
FIG. 1 depicts a front perspective view of a range in accordance with an embodiment of the present disclosure.

Referring to FIG. 1, an exemplary appliance, such as a free standing range, incorporating aspects of the disclosed embodiments, is generally designated by reference numeral 100. The aspects of the disclosed embodiments are generally directed to selective activation of oven heating units, powered by different energy sources, to optimize oven performance and minimize energy usage during peak demand periods in a hybrid cooking appliance that incorporates both electric and gas powered heating assemblies. In a hybrid oven including both electric and gas powered heating assemblies, a normal state of the hybrid oven may be to operate using the electrical heating elements. However, in a period of peak demand, or when it is economically less efficient to utilize electrical power, the aspects of the disclosed embodiments will automatically switch the source of power to the hybrid oven from electric to gas, while maintaining the oven performance. Although the aspects of the disclosed embodiments will be described herein with respect to a range, the aspects of the disclosed embodiments can be generally applied to any appliance that is capable of utilizing multiple energy sources, such as refrigerators, air conditioning systems and hot water heaters, for example.

As is shown in FIG. 1, the range 100 includes a cabinet or housing 2 that has a front portion 4, opposing side panels 6, a base or bottom portion 8, a top portion 10, and a back panel 12. In the embodiment shown in FIG. 1, the top portion 10 of the range 100 includes a cooktop 20 having one or more surface heating elements 22. Heating elements 22 may be electrical or natural gas heating elements, as will be appreciated by one of skill in the art. In alternate embodiments, the range 100 does not include a cooktop 20, such as in the case of a wall oven.

The range 100 also includes an oven unit 24. Although the aspects of the disclosed embodiments are described herein with respect to the single oven configuration shown in FIG. 1, in alternate embodiments, the range 100 could comprise a multiple oven unit. As shown in the example of FIG. 1, the range 100 includes an oven door 26 and a pullout drawer 28, the operation of which is generally understood.

In one embodiment, the cabinet 2 of the range 100 includes a control surface 30 that supports one or more controls, generally referred to herein as burner control(s) 32. The burner control(s) or control knob(s) 32 shown in FIG. 1 are generally in the form of a knob style control that extends outwardly from and can be supported by the control surface 30, which in one embodiment comprises a backsplash. In alternate embodiments, the knob(s) 32 can comprise any suitable switch or control device. In one embodiment, a control panel 34 includes a plurality of input selectors or switches 36 and a display 38 cooperating with control knob(s) 32 to form a user interface for selecting and displaying cooking cycles, warming cycles and/or other operating features, including selection of heating units within the oven unit 24. In one embodiment, the input selectors or controls 36 can be in the form of push buttons or electronic switches.

In one embodiment, the range 100 includes a controller, such as controller 40 described herein. The controller 40 can be coupled to, or integrated within, the control panel 34 and configured to receive inputs and commands from, for example, the controls 32 and 36, as well as external sources, and control the various operations and functions of the oven 100, including the switching of the power source, as will be further described herein. In one embodiment, the controller 40 can include an electronic range control, and can be used to selectively activate heating elements within the oven unit 24, based upon an energy supply factor characteristic of the utility state and/or supplied energy, e.g., electricity demand and/or availability, as is described herein.

Figure 2:
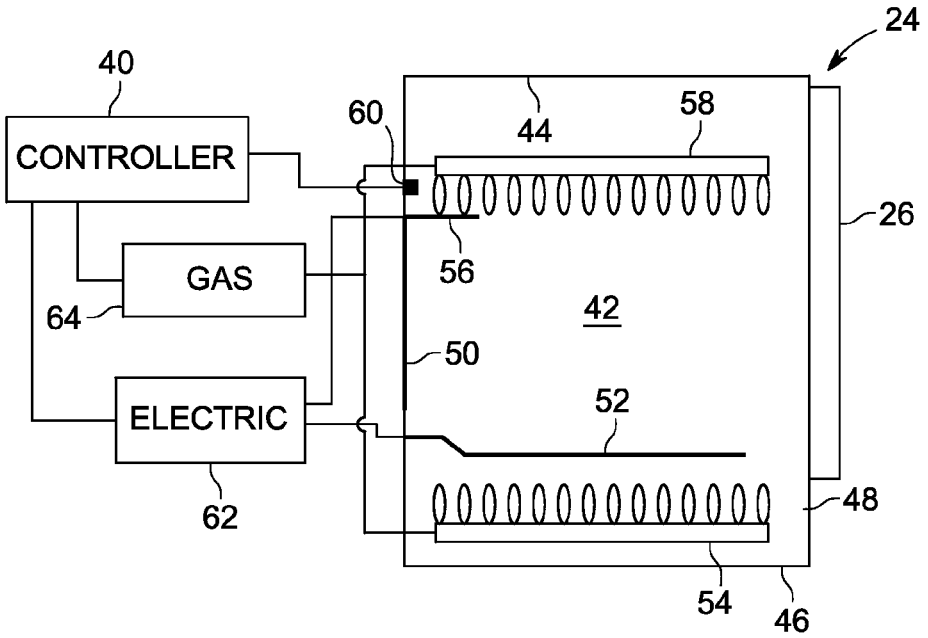
FIG. 2 depicts a schematic cross-sectional view of a portion of dual fuel oven unit in accordance with an embodiment of the present disclosure.

FIG. 2 is a schematic cross-sectional view of a portion of a dual fuel oven unit 24 that can be used with range 100 (shown in FIG. 1). Oven unit 24 includes an oven cavity 42 that is generally defined by a top wall 44, a bottom wall 46, two side walls 48, and a back wall 50. Front-opening access door 26 is hinged on one of side walls 48 and covers the front opening (not shown) of oven cavity 42 in the closed position.

In an exemplary embodiment, oven unit 24 includes a lower electrical heating element 52, also referred to as a bake element, and a lower gas burner 54, also referred to as a bake burner. The lower electrical heating element 52 and lower gas burner 54 are disposed in the lower portion of oven cavity 42, typically attached to or above the bottom wall 46. In one embodiment, the oven unit 24 can also include one or both of an upper electrical heating element 56, also referred to as a broil element, and an upper gas burner 58, also referred to as a broil burner. The upper electrical heating element 56 and upper gas burner 58 are disposed in an upper portion of oven cavity 42, typically attached to or below the top wall 44.

Oven unit 24 also includes a temperature sensor or probe 60 that extends at least partially into oven cavity 42. The temperature sensor 60 is in signal communication with controller 40 in order to maintain a set temperature of the oven cavity 42 by modulating one or more of the heating elements 52-58, as is generally understood in the art.

The electrically operated lower element 52 and upper element 56 are typically coupled to an electrical power supply 62, such as a 120 volt power supply or a 240 volt power supply, for example, in a suitable fashion. The gas operated lower burner 54 and upper burner 58 are coupled to a gas supply 64, also in a fashion that is generally understood.

In one embodiment, each of the electrical power supply 62 and the gas supply 64 are communicatively coupled to the controller 40. The controller 40 is configured to regulate the supply of, to switch between, the gas or electrical power to respective electrical heating elements 52, 56 and gas burners 54, 58 in the oven unit 24 in a manner as described herein. The electrical supply 62 will include suitable relays, switches or other controls for controlling the supply of electrical power to the elements 52, 56, as will be understood in the art, while the gas supply 64 will include suitable valves and switches for controlling the gas flow to the burners 54, 58, as will be understood in the art.

Figure 3:
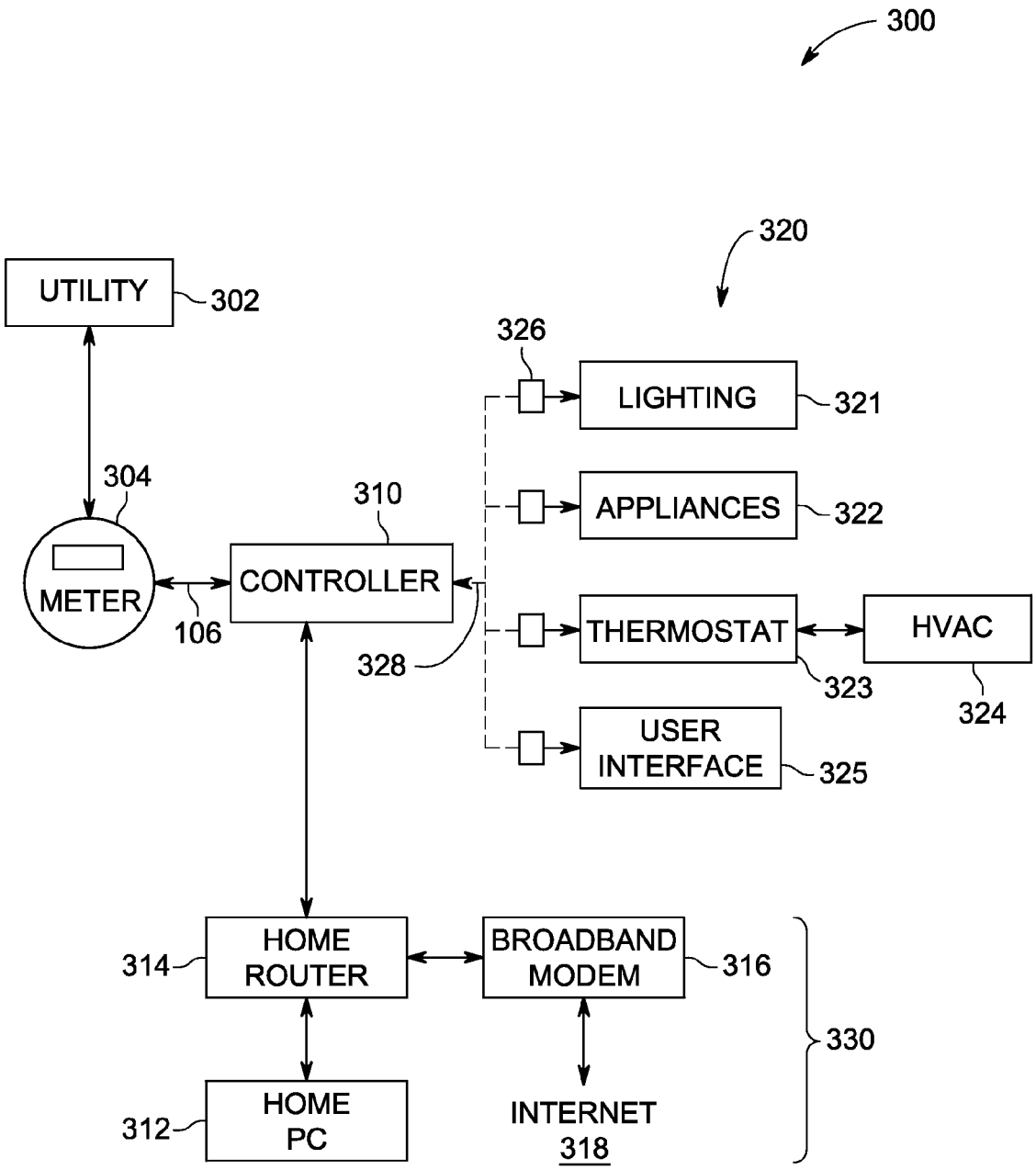
FIG. 3 depicts a schematic diagram of an energy management system in accordance with an embodiment of the present disclosure.

Referring to FIG. 3, the aspects of the disclosed embodiments allow the use of an advanced system 300 to handle energy management between the utility 302 and the homeowner's appliances 320, also referred to herein as "smart" or "intelligent" appliances. In one embodiment, the system 300 can include one or more of a controller 310, utility meter 304, communication network 328, intelligent appliances 320, and a home network 330. Less advanced systems may allow for direct communication between the appliances 320 and the utility meter 304, or mesh the network 328 through a DSMM (Demand Side Management Module). In one embodiment, the controller 310 is a DSM Module, which receives information from either the utility 302 via a smart meter or the internet or a home pc via home router 314.

The home network 330 is generally a computer system that is coupled to the utility 302, either through the meter 304 or via an Internet connection 318, for example, that allows the utility to notify the controller 310 when the utility is in peak demand. In the embodiment shown in FIG. 3, the home network 330 includes a computer 312 coupled to the Internet 318 via a router 314 and modem 316. In alternate embodiments, the home network 330 can be configured to receive information from the utility 302 in any suitable manner over any suitable communication network, including for example, a telecommunication network.

In one embodiment, the utility 302 provides the controller 310 with a signal 106 that is indicative of the occurrence of peak demand, also herein referred to as an energy supply factor. In one embodiment, the signal 106 is generated by the utility 302 to indicate a period of peak demand. Additionally, the homeowner can select a power source based on the rate the utility is charging, for example, at different times of the day. The controller 310 can also evaluate the energy consumption used by the home via the utility meter 304 at a specific point in time and determine if the home is exceeding a demand limit that is set by the utility or homeowner. If the demand limit is exceeded, the controller 310 can control the appliances 320 in a suitable manner.

As shown in FIG. 3, each intelligent appliance 320 has or is coupled to a communication interface 326 that is communicatively linked to the controller 310 via the network 328, or other suitable communication means. Although the communication interface 326 is shown as a separate device for each intelligent appliance 320, in one embodiment, the communication interface 326 is a single unit shared by the different appliances 321-324. The communication interface 326 can be a power-line carrier receptive of data via electrical power transmission lines, a wireless device, and/or a wired communication interface that allows the transfer and exchange of data and information between each of the intelligent appliances 320 and the controller 310. The controller 310 will communicate with, and control, the lighting 321, appliances 322, and thermostat 323 (for HVAC 324), to execute the user's preferences/settings. In one embodiment, the user inputs the settings and preferences via the user interface 325. The user interface 325 can comprise, be part of, or communicatively coupled to the user interface 34 described with respect to FIG. 1. The appliances 322 shown in FIG. 3 can generally include the appliance 100 illustrated in FIG. 1.

In the system 300 of FIG. 3, the intelligent appliances 320 respond to, or are controlled by, the signal 106 from the utility meter 304 to lower the peak load on the utility 302 and reduce the amount of energy that the consumer uses during peak energy demand periods. The signal 106 may generated by the utility provider 302, such as a power company, and can be transmitted via a power transmission line, as a radio frequency signal, or by any other means for transmitting a signal when the utility provider 302 desires to reduce demand for its resources. Other suitable methods are described in U.S. patent application Ser. No. 12/559, 597.

Figure 4:
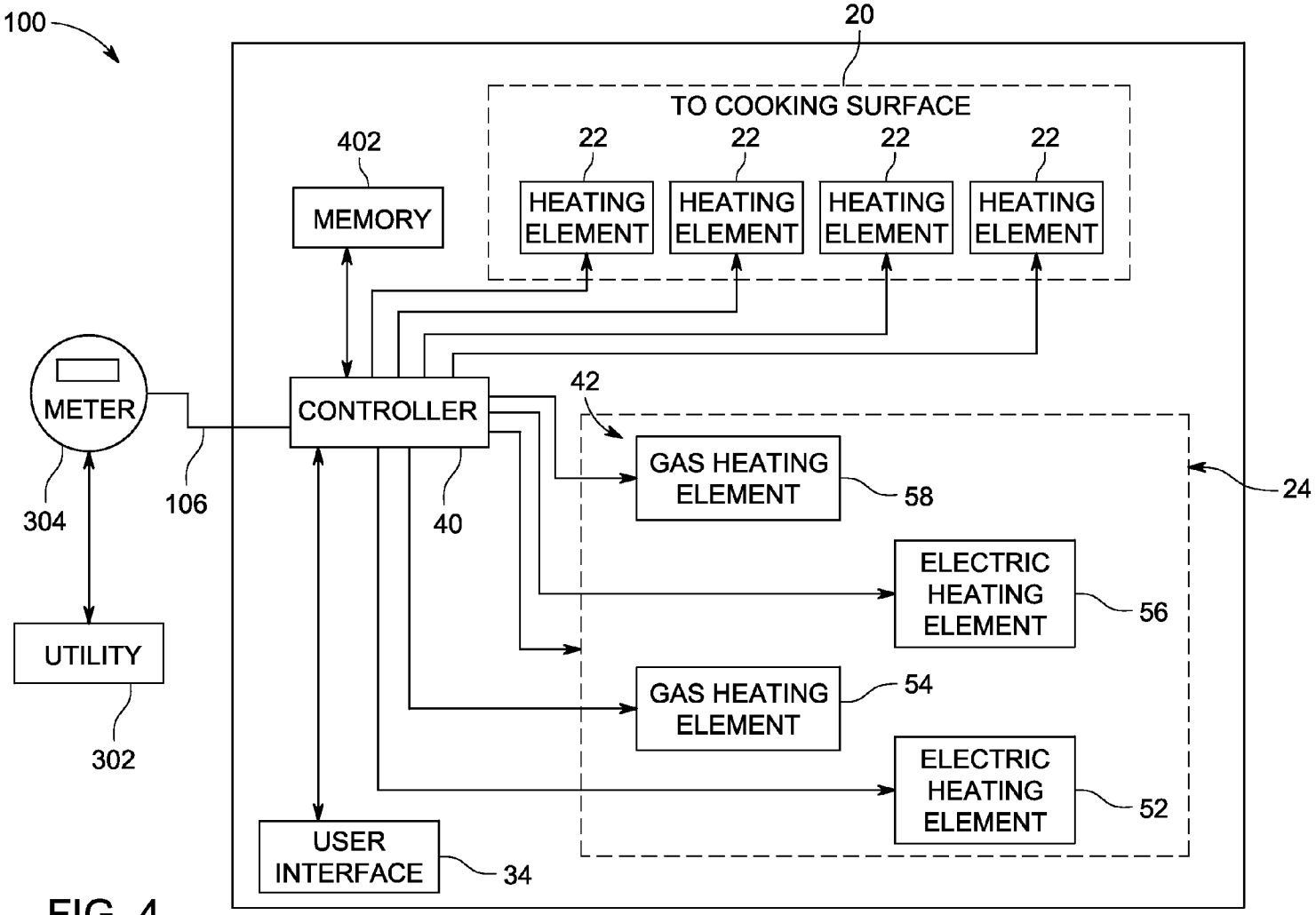
FIG. 4 depicts a schematic illustration of the demand managed cooking appliance shown in FIG. 1 in accordance with an embodiment of the present disclosure.

FIG. 4 is a schematic illustration of the demand managed cooking appliance 100 shown in FIG. 1. As noted, the appliance 100 includes one or more power consuming features/functions, such as the surface heating elements 22, electric oven heating elements 52, 56 and oven gas burners 54, 58. The controller 40, which in one embodiment is part of, or communicatively coupled to the controller 310 of FIG. 3, is operatively connected to each of the heating elements 22, the lower and upper electrical heating elements 52, 56 and the lower and upper gas burners 54, 58. The controller 40 can also be coupled to a memory unit 402 and the user interface 325 of FIG. 3. In one embodiment, the controller 40 includes a microcomputer(s) or processor(s) on a printed circuit board which is programmed to selectively control the source of power to the oven unit 24 in accordance with the aspects of the disclosed embodiments described herein.

In the embodiment of FIG. 4, the controller 40 is configured to receive and process the signal 106. The signal 106 is received from the utility meter 304. Alternatively, the signal 106 can be received directly from the utility 302. The signal 106 can be indicative of the state of the demand, or a supply factor, for the utility's energy. For example, a relatively high price may be associated with a peak demand state or period, and a relative low price or cost is typically associated with an off-peak demand state or period.

The controller 40 can operate the appliance 100 in one of a plurality of operating modes, including a normal operating mode and an energy savings mode. In one embodiment, the controller 40 can switch between the normal operating mode and the energy savings mode in response to the received signal 106. Specifically, the appliance 100 can be switched to operate in the energy savings mode in response to a state of signal 106 that indicates a peak demand state or period. For purposes of the description herein, the energy savings mode is a mode where the source of energy being used to power the oven cavity 24 is switched from an energy source that is subject to peak demand, such as electrical power, to an energy source that is not subject to peak demand constraints, such as natural gas. As will be discussed in greater detail below, the controller 40 is configured to selectively switch between the consumption of electrical energy or gas to reduce consumption of peak demand power by the cooking appliance 100 in the energy savings mode.

The controller 40 is responsive to the utility state to selectively activate operational aspects of the appliance 100. For example, in one scenario during a peak demand period, the controller 40 will receive a signal 106 from the utility 302, home network 330, or user interface 325 that indicates the appliance 100 or system 300 has exceeded a demand limit. Responsive to the signal 106, the controller 40 allocates, or switches the power source to appliance 100 based on two factors. A priority dictates which appliances 321-324 have higher priority to be in full energy mode than other appliances. Energy need dictates how much energy is required in a certain time period in order for each appliance to function properly. If an appliance's energy need to function properly exceeds the energy available in the energy saving mode, the appliance moves to a normal mode. The energy saving mode is typically a lower energy usage mode for the appliance such as shutdowns of compressors and motors, delayed cycles, higher operating temperatures in summer, lower operating temperatures in winter until the peak demand period is over, or use of an alternate available energy source. Once the demand limit is reached, the appliances will begin to transition into energy saving mode based on the priority and energy need level. The controller 40 receives periodic status updates from the utility 302 and appliances 321-324 in order to determine the appropriate mode of operation and if priorities need to change to maintain operation of the system 300 beneath the demand limit.

If the controller 40 receives and processes signal 106 indicative of a peak demand period or that the peak demand limit has been exceeded, the controller 40 determines whether one or more of the power consuming features/functions should be operated in the energy savings mode and if so, it signals the appropriate features/functions of the appliance 100 to begin operating in the energy savings mode to reduce the instantaneous peak energy demand by the appliance. For example, it has been observed that use of electrical power to heat an oven, such as oven cavity 42 of range 100 provides generally preferred temperature control. Accordingly, in one embodiment, the range 100 may operate in the normal mode using electrical heating elements 52, 56 and transition to use of gas burners 54, 58 in the energy savings mode.

In response to determination of a peak energy demand or that a peak demand limit has been exceeded, the controller 40 may transition the oven from normal to energy savings mode. In an exemplary embodiment, the controller 40 is responsive to the signal 106 to determine that the peak demand limit has been reached and selectively activates the gas burners 54, 48 to initiate a transition from use of the electric heating elements 52, 56 to gas burners 54, 58 to heat the oven cavity 42. The transition from the use of electric heating elements 52, 56 to gas burners 54, 58 is temperature based, and therefore controlled in a manner to maintain an appropriate cooking temperature within oven cavity 42.

The controller 40 is responsive to determination that the peak demand limit has been exceeded during a cooking operation to regulate a decrease in electricity, via electrical supply 62 to the electrical heating elements 52, 56 and an increase in natural gas, via supply 64 to the gas burners 54, 58. Heat to maintain the desired temperature in the oven is supplied by duty cycle control of the heat source. In one embodiment the transition from electricity to gas involves simply switching from duty cycling the electric element or elements to duty cycling the gas burner or burners, as necessary to maintain the desired oven temperature. It is also contemplated that the temperature based transition may include a temporary overlap of energy supply from both electrical and gas energy via supplies 62, 64. For example, the electrical heating elements 52, 54 may initially operate at reduced power while the gas burners 54, 58 begin to affect the heating of the oven cavity 42. As the gas burners 54, 58 increase their contribution of heating the oven cavity 42; the electrical heating elements 52, 54 may be turned off to reduce power consumption beneath the peak demand limit. In this manner, the temperature based transition maintains proper cooking temperature within the oven cavity 42 during the transition from normal (electric) to energy savings (natural gas) mode. In some embodiments, the power consumption may be reduced beneath the peak demand limit by increasing the energy provided by gas supply 64 and reducing the electrical supply 62 without necessarily fully deactivating the electrical heating elements 52, 54.

As described above with reference to FIGS. 1 through 3, the controller 310 receives periodic status updates from the utility 302 and appliances, such as range 100. The controller 310 determines the present operational mode, and if operation of the system 300 is beneath the demand limit, the controller 310 may require (or allow) a change in operational mode of the appliances. For example, the controller 310 is responsive to a determination that operation of the oven 24 at a desired temperature does not exceed the demand limit to transition to use of electrical power, via energy supplies 62, 64 to heat the oven. As described above, the transition may be temperature based, and thereby maintain a desired cooking temperature within the oven cavity 42.

Figure 5:
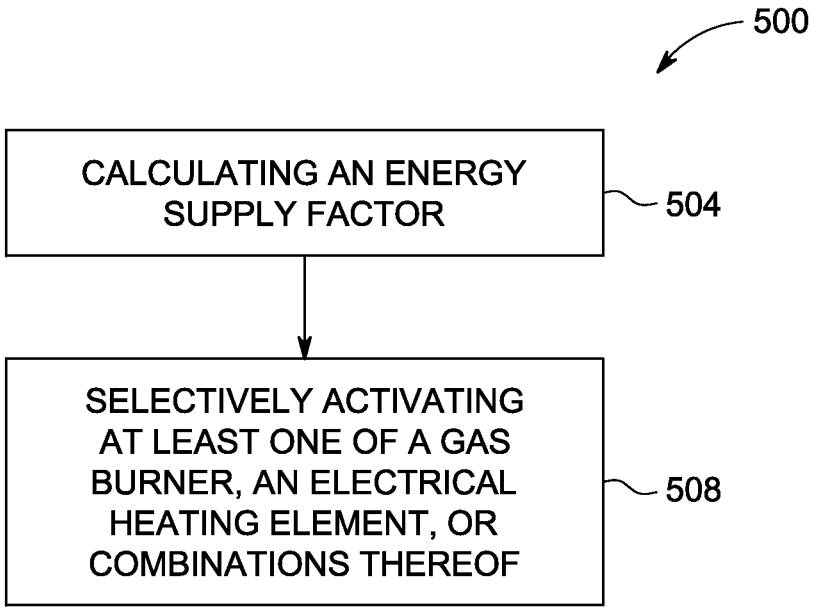
FIG. 5 depicts a flowchart of an exemplary process in accordance with an embodiment of the present disclosure.

In view of the foregoing, the controller 40 facilitates a method of operating an oven 24. FIG. 5 depicts a flowchart 500 of exemplary process steps of operating an oven, such as oven 24. At process step 504, the controller 40 calculates an energy supply factor, such as to compare a present electricity demand to a peak electrical demand limit. At process step 508, based upon the energy supply factor calculated at step 504, the controller 40 selectively activates one or more of the gas burners 54, 58, one or more of the electrical heating elements 52, 56, or a combination thereof.

In an embodiment, the process step 504 of calculating the energy supply factor may be based upon various inputs, including without limitation, time of day, season of year, geographic location, and relative present demand of natural gas and electricity. In an embodiment, the process step 508 may include selectively activating elements using only one energy source, such as gas burners 54, 58 or electrical heating elements 52, 56.

Embodiments of the process may also include receiving, at the controller 40, data such as from the Internet 318. Some embodiments may include a wireless connection to the Internet. Some embodiments may include receiving the data via the electrical power supply 62, shown in FIG. 2.

While embodiments of the disclosure have been described as a dual-fuel oven, it will be appreciated that the scope of the disclosure is not so limited and may apply to ranges with other arrangements of heating sources, such as dual-fuel surface heating elements, for example.

As disclosed, some embodiments of the disclosure may include some of the following advantages: an ability to specify an energy supply source used to heat an oven; an ability to calculate an energy supply factor; and an ability to reduce peak energy usage.

An embodiment of the disclosure may be embodied in the form of computer-implemented processes and apparatuses for practicing those processes. Embodiments of the present disclosure may also be embodied in the form of a computer program product having computer program code containing instructions embodied in tangible media, such as floppy diskettes, CD-ROMs, hard drives, USB (universal serial bus) drives, or any other computer readable storage medium, wherein, when the computer program code is loaded into and executed by a computer, the computer becomes an apparatus for practicing the invention. Embodiments of the disclosure also may be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein when the computer program code is loaded into and executed by a computer, the computer becomes an apparatus for practicing aspects of the disclosure. When implemented on a general-purpose microprocessor, the computer program code segments configure the microprocessor to create specific logic circuits. A technical effect of the executable instructions is to calculate an energy supply factor and select an available energy supply source based upon a desired criterion.

Thus, while there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An appliance comprising:

an oven cavity;

a gas burner disposed within the oven cavity;

an electrical heating element disposed within the oven cavity;

a temperature sensor configured to sense a temperature within the oven cavity;

a controller in operative communication with the gas burner and the electrical heating element, the controller being configured to calculate an energy supply factor, the controller further being configured to operate the appliance based on a demand limit and the energy supply factor, wherein the energy supply factor is calculated based on a relative present demand of gas and electricity;

the controller further configured to receive a signal indicative of a current state of an associated utility, and to selectively activate at least one of the gas burner and the electrical heating element based upon the demand limit, the calculated energy supply factor and the signal;

the controller being further configured to communicate with the temperature sensor to operate the appliance in a transitional mode wherein the oven cavity is heated by both the electrical heating element and the gas burner so that the temperature within the oven cavity is maintained during a transition from a normal mode to an energy savings mode in response to a determination that the demand limit has been exceeded.

2. The appliance of claim 1, wherein the current state is indicative of a peak electrical demand period; and the controller selectively activates only the gas burner in response to the signal.

3. An oven comprising:

an oven cavity;

a gas burner disposed within the oven cavity;

an electrical heating element disposed within the oven cavity, a temperature sensor configured to sense a temperature within the oven cavity;

a controller in operative communication with the gas burner and the electrical heating element, the controller being configured operate the oven based on a user selected demand limit and to calculate an energy supply factor, wherein the energy supply factor is calculated based on a relative present demand of gas and electricity; the controller being further configured to selectively activate at least one of the gas burner and the electrical heating element based upon the demand limit and the energy supply factor; the controller being further configured to communicate with the temperature sensor to operate the oven in a transitional mode wherein the oven cavity is heated by both the electrical heating element and the gas burner so that the temperature within the oven cavity is maintained during a transition from a normal mode to an energy savings mode in response to a determination that the demand limit has been exceeded.

4. The oven of claim 3, wherein the controller selectively activates only the gas burner based upon the energy supply factor.

5. The oven of claim 3, wherein the energy supply factor is based upon a peak demand limit of electricity.

6. The oven of claim 5, wherein the energy supply factor is based upon a comparison of a present electrical consumption of the oven to the peak demand limit.

7. The oven of claim 3, wherein the controller is in signal communication with the Internet.

8. The oven of claim 7, wherein the controller receives data regarding a peak demand period of electricity via the Internet.

9. The oven of claim 3, wherein the controller receives data regarding a peak demand period of electricity via a power line carrier.

10. A method of operating an oven comprising a controller, the method comprising:

inputting a demand limit into the controller:

calculating an energy supply factor at the controller, wherein the energy supply factor is calculated based on a relative present demand of gas and electricity;

in response to the input demand limit and the calculated energy supply factor, selectively activating by the controller at least one of a gas burner and an electrical heating element, the gas burner and the electrical heating element being disposed within an oven cavity of the oven and in operative communication with the controller;

measuring, by a temperature sensor, a temperature within the oven cavity; the temperature sensor is in operative communication with the controller; and operating the oven in a transitional mode including heating the oven cavity with both the electrical heating element and the gas burner so that the temperature within the oven cavity is maintained during a transition from a normal mode to an energy savings mode in response to a determination the demand limit has been exceeded.

11. The method of claim 10, wherein the selectively activating comprises selectively activating one of the gas burner and the electrical heating element.

12. The method of claim 10, wherein the energy supply factor is based upon a peak demand limit of electricity.

13. The method of claim 12, wherein the energy supply factor is based upon a comparison of a present electrical consumption of the oven to the peak demand limit.

14. The method of claim 10, wherein the calculating comprises receiving data regarding a peak demand period of electricity via the Internet.

15. The method of claim 14, wherein the receiving comprises receiving the energy supply factor via a wireless connection.

16. The method of claim 10, wherein the receiving comprises receiving the energy supply factor via a power line carrier.

17. The method of claim 16, wherein the energy supply factor comprises a peak demand of electricity.

* * * * *